US010494228B2

(12) United States Patent
Swaybill et al.

(10) Patent No.: US 10,494,228 B2
(45) Date of Patent: Dec. 3, 2019

(54) GUIDING DEVICES FOR ELEVATOR SYSTEMS HAVING ROLLER GUIDES AND MOTION SENSORS

(71) Applicant: Otis Elevator Company, Farmington, CT (US)

(72) Inventors: Bruce P. Swaybill, Farmington, CT (US); Randy Roberts, Hebron, CT (US); Patricia Derwinski, Farmington, CT (US); Philip R. James, Tolland, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 419 days.

(21) Appl. No.: 15/444,522

(22) Filed: Feb. 28, 2017

(65) Prior Publication Data

US 2018/0244495 A1 Aug. 30, 2018

(51) Int. Cl.

| | |
|---|---|
| ***B66B 1/34*** | (2006.01) |
| ***B66B 7/04*** | (2006.01) |
| ***B66B 1/40*** | (2006.01) |

(52) U.S. Cl.

CPC ..... *B66B 7/046* (2013.01); *B66B 1/3492* (2013.01); *B66B 1/40* (2013.01)

(58) Field of Classification Search

CPC ..... B66B 7/046; B66B 1/3492; B66B 1/40
USPC ..... 187/247, 277, 283, 284, 291, 391, 394
See application file for complete search history.

(56) References Cited

U.S. PATENT DOCUMENTS 4,864,208 A * 9/1989 Schroder ..... B66B 1/3492 318/603
5,304,751 A * 4/1994 Skalski ..... B66B 1/44 187/393
5,524,730 A * 6/1996 Roberts ..... B66B 7/041 187/292
5,816,369 A * 10/1998 Skalski ..... B66B 7/046 187/410

(Continued)

FOREIGN PATENT DOCUMENTS

CN 101287670 10/2008
CN 101780908 7/2010

(Continued)

OTHER PUBLICATIONS

European Search Report, European Application No. 18159277.5, dated Sep. 24, 2018, European Patent Office; EP Search Report 7 pages.

*Primary Examiner* — Anthony J Salata
(74) *Attorney, Agent, or Firm* — Cantor Colburn LLP

(57) ABSTRACT

Elevator car guiding devices including a roller guide frame including a mounting base to be mounted to an elevator car, a first roller supported on the mounting base, the first roller having a first roller wheel configured to engage with and rotate along a guide rail and prevent movement of the elevator car in a first direction, a second roller supported on the mounting base, the at least one second roller having a second roller wheel configured to engage with and rotate along the guide rail and prevent movement of the elevator car in a second direction, and a motion state sensing assembly mounted to the roller guide frame and configured to measure a motion state of the elevator car within an elevator shaft of the elevator system.

20 Claims, 6 Drawing Sheets

(56) References Cited

U.S. PATENT DOCUMENTS

| | | | | |
|---|---|---|---|---|
| 6,877,587 | B2 * | 4/2005 | Kunz | B66B 1/3492 187/394 |
| 7,540,358 | B2 * | 6/2009 | Okamoto | B66B 5/04 187/394 |
| 7,588,127 | B2 * | 9/2009 | Shiratsuki | B66B 1/3492 187/391 |
| 7,621,377 | B2 * | 11/2009 | Husmann | B66B 7/042 187/292 |
| 7,950,499 | B2 * | 5/2011 | Okamoto | B66B 1/3492 187/293 |
| 9,957,136 | B2 * | 5/2018 | Hawkins | B66B 7/1246 |
| 2015/0217972 | A1 | 8/2015 | Hawkins et al. | |
| 2016/0214834 | A1 | 7/2016 | Cunningham et al. | |
| 2018/0162693 | A1 * | 6/2018 | Hu | B66B 5/06 |
| 2019/0002235 | A1 * | 1/2019 | Roberts | B66B 1/30 |

FOREIGN PATENT DOCUMENTS

| | | | |
|---|---|---|---|
| CN | 102001564 | | 4/2011 |
| CN | 102115001 | | 7/2011 |
| CN | 103086220 | | 5/2013 |
| CN | 103241611 | | 8/2013 |
| EP | 1749778 | | 2/2007 |
| EP | 1955972 | A1 | 8/2008 |
| EP | 2043935 | | 4/2009 |
| EP | 2578526 | | 4/2013 |
| EP | 3130554 | A1 | 2/2017 |
| JP | 2010275078 | | 12/2010 |
| JP | 5963335 | | 8/2016 |
| WO | 2006073015 | A1 | 7/2006 |
| WO | 2008011895 | A1 | 1/2008 |

* cited by examiner

GUIDING DEVICES FOR ELEVATOR SYSTEMS HAVING ROLLER GUIDES AND MOTION SENSORS

BACKGROUND

The subject matter disclosed herein generally relates to elevator systems and, more particularly, to sensing elevator car guiding devices for elevator systems to connect an elevator car to a guide rail.

An elevator system typically includes a plurality of belts or ropes (load bearing members) that move an elevator car vertically within a hoistway or elevator shaft between a plurality of elevator landings. When the elevator car is stopped at a respective one of the elevator landings, changes in magnitude of a load within the car can cause changes in vertical motion state (e.g., position, velocity, acceleration) of the car relative to the landing. The elevator car can move vertically down relative to the elevator landing, for example, when one or more passengers and/or cargo move from the landing into the elevator car. In another example, the elevator car can move vertically up relative to the elevator landing when one or more passengers and/or cargo move from the elevator car onto the landing. Such changes in the vertical position of the elevator car can be caused by soft hitch springs and/or stretching and/or contracting of the load bearing members, particularly where the elevator system has a relatively large travel height and/or a relatively small number of load bearing members. Under certain conditions, the stretching and/or contracting of the load bearing members and/or hitch springs can create disruptive oscillations in the vertical position of the elevator car, e.g., an up and down "bounce" motion.

SUMMARY

According to some embodiments, elevator car guiding devices are provided. The elevator car guiding devices include a roller guide frame including a mounting base to be mounted to an elevator car, a first roller supported on the mounting base, the first roller having a first roller wheel configured to engage with and rotate along a guide rail and prevent movement of the elevator car in a first direction, a second roller supported on the mounting base, the at least one second roller having a second roller wheel configured to engage with and rotate along the guide rail and prevent movement of the elevator car in a second direction, and a motion state sensing assembly mounted to the roller guide frame and configured to measure a motion state of the elevator car within an elevator shaft of the elevator system.

In addition to one or more of the features described herein, or as an alternative, further embodiments of the elevator car guiding devices may include that the motion state sensing assembly is operably connected to one of (i) the first roller, (ii) one of the at least one second roller, or (iii) the guide rail.

In addition to one or more of the features described herein, or as an alternative, further embodiments of the elevator car guiding devices may include that the motion state sensing assembly includes an encoder and a connecting element operably connecting the encoder to one of the roller wheels, wherein the connecting element rotates as the respective roller wheel rotates, the encoder configured to measure rotation of the connecting element to determine a motion state of the elevator car.

In addition to one or more of the features described herein, or as an alternative, further embodiments of the elevator car guiding devices may include that the roller guide frame includes a cover, wherein the first roller and the at least one second roller are arranged between the mounting base and the cover, and wherein the motion state sensing assembly is mounted to the cover.

In addition to one or more of the features described herein, or as an alternative, further embodiments of the elevator car guiding devices may include that the roller guide frame includes a first support bracket that supports the first roller wheel within the roller guide and wherein the motion state sensing assembly comprises an encoder bracket that fixedly secures an encoder to the first support bracket.

In addition to one or more of the features described herein, or as an alternative, further embodiments of the elevator car guiding devices may include a connecting element operably connected the encoder to the first roller wheel.

In addition to one or more of the features described herein, or as an alternative, further embodiments of the elevator car guiding devices may include that the motion state sensing assembly comprises a communication component configured to transmit motion state data from the motion state sensing assembly to an elevator controller.

In addition to one or more of the features described herein, or as an alternative, further embodiments of the elevator car guiding devices may include that a portion of the motion state sensing assembly is operably in direct contact with the first roller wheel.

In addition to one or more of the features described herein, or as an alternative, further embodiments of the elevator car guiding devices may include that the at least one second roller is two second rollers with each second roller having a respective roller wheel oriented about the guide rail.

In addition to one or more of the features described herein, or as an alternative, further embodiments of the elevator car guiding devices may include that the motion state sensing assembly is operably connected to one of the two second roller wheels.

According to some embodiments, elevator systems are provided. The elevator systems include an elevator shaft having a plurality of landings, a guide rail extending along the elevator shaft, an elevator machine, an elevator car operably connected to the elevator machine to be driven within the elevator shaft along the guide rail, and an elevator car guiding device mounted to the elevator car. The elevator car guiding device includes a roller guide frame including a mounting base mounted to the elevator car, a first roller supported on the mounting base, the first roller having a first roller wheel configured to engage with and rotate along the guide rail and prevent movement of the elevator car in a first direction, at least one second roller supported on the mounting base, the at least one second roller having a second roller wheel configured to engage with and rotate along the guide rail and prevent movement of the elevator car in a second direction, and a motion state sensing assembly mounted to the roller guide frame and configured to measure a motion state of the elevator car within the elevator shaft.

In addition to one or more of the features described herein, or as an alternative, further embodiments of the elevator systems may include that the motion state sensing assembly is operably connected to one of (i) the first roller, (ii) one of the at least one second roller, or (iii) the guide rail.

In addition to one or more of the features described herein, or as an alternative, further embodiments of the elevator systems may include that the motion state sensing assembly includes an encoder and a connecting element operably connecting the encoder to one of the roller wheels, wherein the connecting element rotates as the respective roller wheel rotates, the encoder configured to measure rotation of the connecting element to determine a motion state of the elevator car within the elevator shaft.

In addition to one or more of the features described herein, or as an alternative, further embodiments of the elevator systems may include that the roller guide frame includes a cover, wherein the first roller and the at least one second roller are arranged between the mounting base and the cover, and wherein the motion state sensing assembly is mounted to the cover.

In addition to one or more of the features described herein, or as an alternative, further embodiments of the elevator systems may include that the roller guide frame includes a first support bracket that supports the first roller wheel within the roller guide and wherein the motion state sensing assembly comprises an encoder bracket that fixedly secures an encoder to the first support bracket.

In addition to one or more of the features described herein, or as an alternative, further embodiments of the elevator systems may include a connecting element operably connected the encoder to the first roller wheel.

In addition to one or more of the features described herein, or as an alternative, further embodiments of the elevator systems may include that the motion state sensing assembly comprises a communication component configured to transmit motion state data from the motion state sensing assembly to the elevator machine.

In addition to one or more of the features described herein, or as an alternative, further embodiments of the elevator systems may include that a portion of the motion state sensing assembly is operably in direct contact with the first roller wheel.

In addition to one or more of the features described herein, or as an alternative, further embodiments of the elevator systems may include that the at least one second roller is two second rollers with each second roller having a respective roller wheel oriented about the guide rail.

In addition to one or more of the features described herein, or as an alternative, further embodiments of the elevator systems may include that the motion state sensing assembly is operably connected to one of the two second roller wheels.

Technical effects of embodiments of the present disclosure include an integrated motion state sensing assemblies that are integrated into roller guides of an elevator car to provide accurate motion state information of the elevator car within an elevator shaft. The term "motion state" as used herein include various states of position/motion, including position, velocity, and acceleration.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1A:
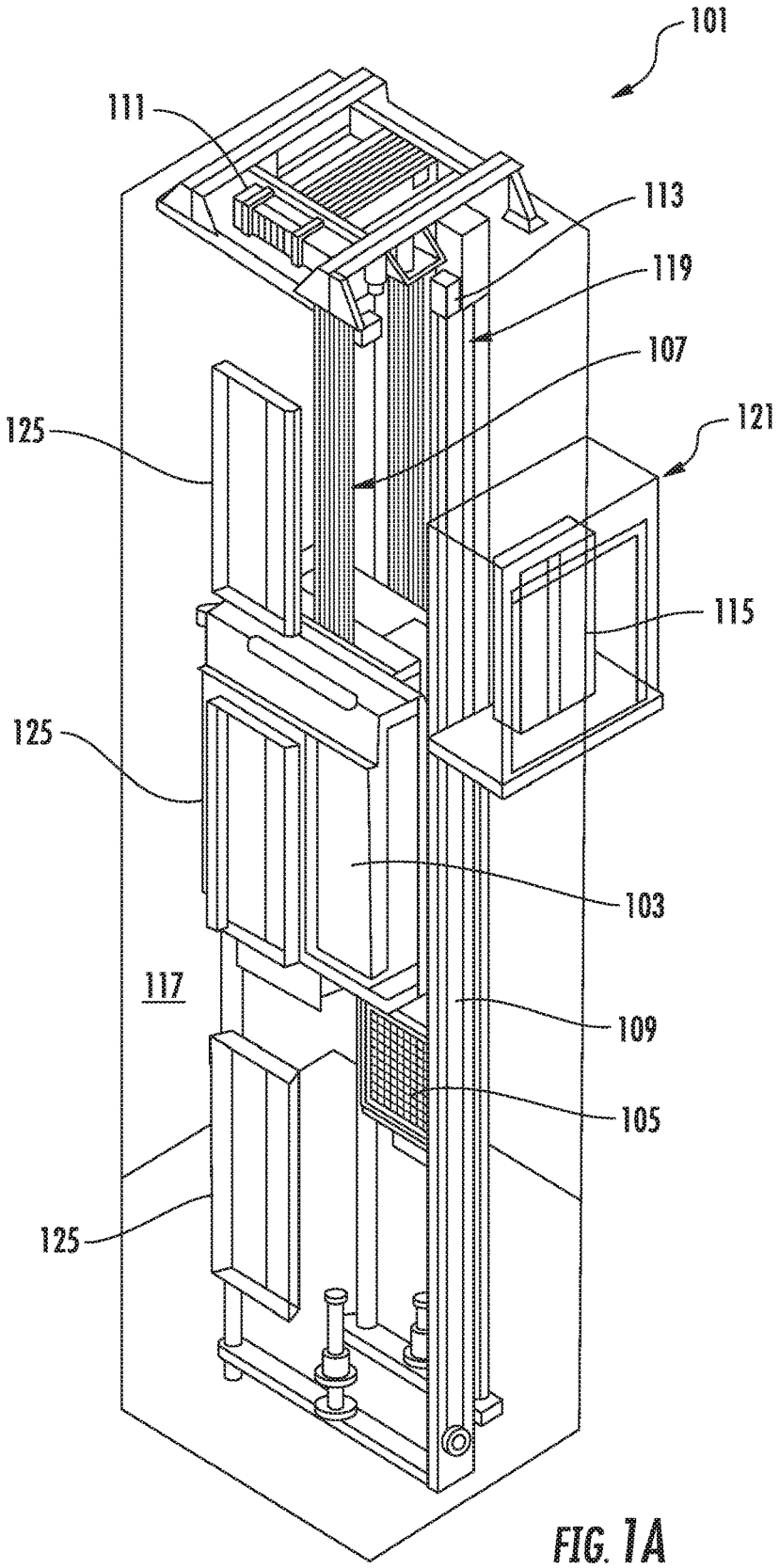
FIG. 1A PRIOR ART
FIG. 1A is a schematic illustration of an elevator system that may employ various embodiments of the disclosure.

As shown and described herein, various features of the disclosure will be presented. Various embodiments may have the same or similar features and thus the same or similar features may be labeled with the same reference numeral, but preceded by a different first number indicating the figure to which the feature is shown. Thus, for example, element "a" that is shown in FIG. X may be labeled "Xa" and a similar feature in FIG. Z may be labeled "Za." Although similar reference numbers may be used in a generic sense, various embodiments will be described and various features may include changes, alterations, modifications, etc. as will be appreciated by those of skill in the art, whether explicitly described or otherwise would be appreciated by those of skill in the art.

FIG. 1A is a perspective view of an elevator system 101 including an elevator car 103, a counterweight 105, a roping 107, a guide rail 109, a machine 111, a position encoder 113, and a controller 115. The elevator car 103 and counterweight 105 are connected to each other by the roping 107. The roping 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator shaft 117 and along the guide rail 109.

The roping 107 engages the machine 111, which is part of an overhead structure of the elevator system 101. The machine 111 is configured to control movement between the elevator car 103 and the counterweight 105. The position encoder 113 may be mounted on an upper sheave of a speed-governor system 119 and may be configured to provide position signals related to a position of the elevator car 103 within the elevator shaft 117. In other embodiments, the position encoder 113 may be directly mounted to a moving component of the machine 111, or may be located in other positions and/or configurations as known in the art.

The controller 115 is located, as shown, in a controller room 121 of the elevator shaft 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position encoder 113. When moving up or down within the elevator shaft 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor.

Although shown and described with a roping system, elevator systems that employ other methods and mechanisms of moving an elevator car within an elevator shaft may employ embodiments of the present disclosure. FIG. 1A is merely a non-limiting example presented for illustrative and explanatory purposes.

Figure 1B:
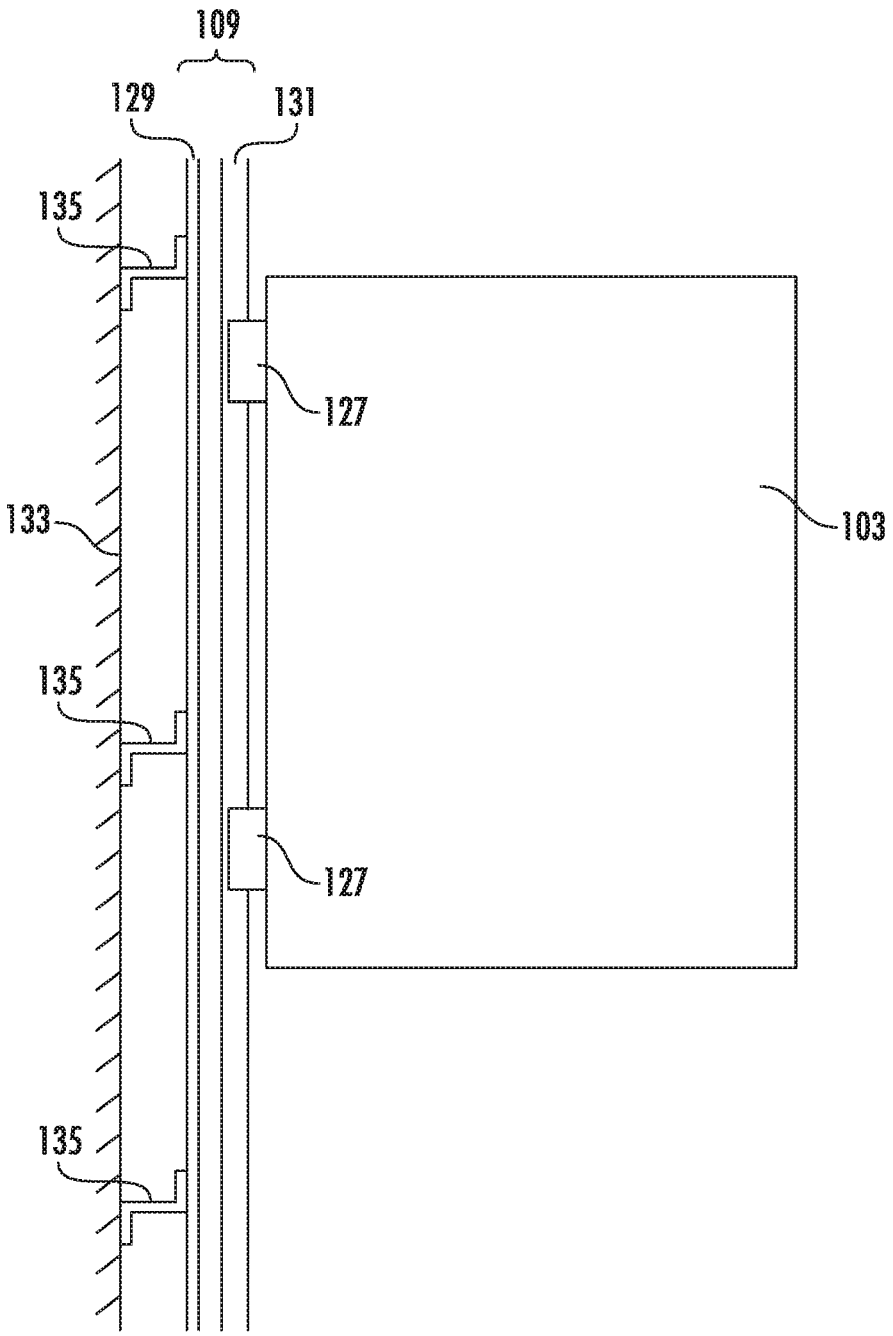
FIG. 1B PRIOR ART
FIG. 1B is a side schematic illustration of an elevator car of FIG. 1A attached to a guide rail track.

FIG. 1B is a side view schematic illustration of the elevator car 103 as operably connected to the guide rail 109. As shown, the elevator car 103 connects to the guide rail 109 by one or more guiding devices 127. The guiding devices 127 may be guide shoes, rollers, etc., as will be appreciated by those of skill in the art. The guide rail 109 defines a guide rail track that has a base 129 and a blade 131 extending therefrom. The guiding devices 127 of the elevator car 103 are configured to run along and/or engage with the blade 131 of the guide rail 109. The guide rail 109 mounts to a wall 133 of the elevator shaft 117 (shown in FIG. 1A) by one or more brackets 135. The brackets 135 are configured to fixedly mount to the wall 133, such as by bolts, fasteners, etc. as known in the art. The base 129 of the guide rail 109 fixedly attaches to the brackets 135, and thus the guide rail 109 can be fixedly and securely mounted to the wall 133. As will be appreciated by those of skill in the art, a guide rail of a counterweight of an elevator system may be similarly configured.

Embodiments provided herein are directed to apparatuses, systems, and methods related to elevator control at a landing, and particularly to vibration compensation systems to rapidly adjust and account for bounce, oscillations, and/or vibrations within an elevator system. For example, an elevator dynamic compensation control mode is a mode of operation that is used at landings when an elevator car may move up or down (e.g., bounce) due to load changes and/or extension/contraction of load bearing members (e.g., a continuous re-levelling feature). According to embodiments provided herein, systems, structures, and methods of operation are provided to enable improved motion state detection with respect to the location of an elevator car within an elevator shaft. In addition to re-leveling and dynamic compensation control, embodiments provided herein can be used for normal operation/motion control, automated recover options, diagnostics, calibration at installation, etc. Thus, embodiments of the present disclosure are not limited to one specific application, and any particular applications described herein are provided for illustrative and explanatory purposes only.

Specifically, embodiments provided herein are directed to incorporating a motion state detection element and/or functionality into roller guides of an elevator car (e.g., guiding devices 127 shown in FIG. 1B). That is, in accordance with embodiments of the present disclosure, a motion state sensing element (e.g., an encoder) is incorporated into the guiding device such that an accurate motion state of the elevator car within the elevator shaft can be determined. The motion state information can then be used to minimize vibration, oscillation, and bounce of the elevator car.

Figure 2A:
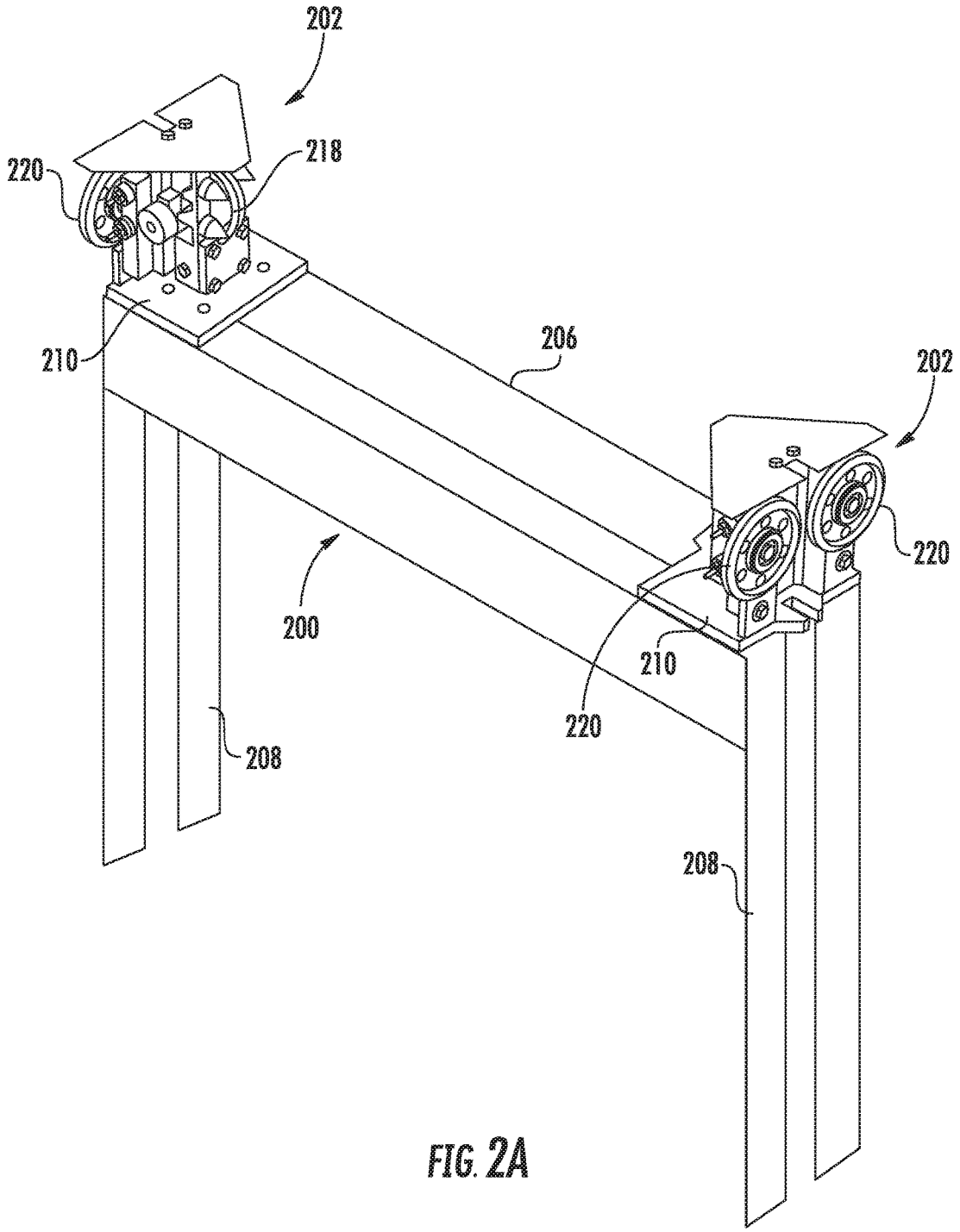
FIG. 2A is a partial isometric illustration of an elevator car frame having roller guides in accordance with an embodiment of the present disclosure mounted thereto.
Figure 2B:
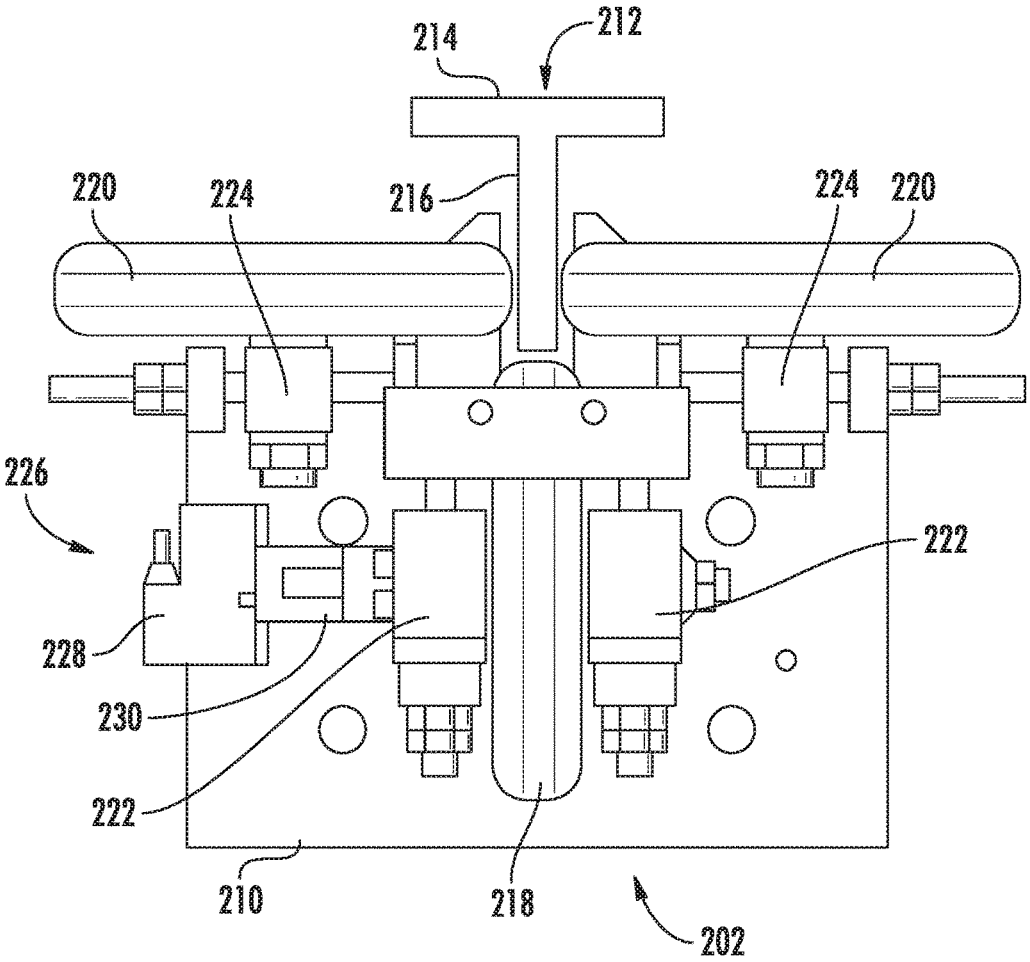
FIG. 2B is a plan view schematic illustration of one of the roller guides of FIG. 2A.

Turning now to FIGS. 2A-2B, schematic illustrations of elevator car guiding devices in accordance with a non-limiting embodiment of the present disclosure are shown. FIG. 2A is a partial isometric illustration of an elevator car frame 200 having two elevator car guiding devices 202 installed thereon. FIG. 2B is a top-down schematic illustration of an elevator car guiding device 202 as engaged within a guide rail 204 of an elevator system. The elevator car frame 200 includes a crosshead frame 206 extending between vertical stiles 208. The elevator car guiding devices 202 are mounted to at least one of the crosshead from 206 and the vertical stiles 208, as known in the art, at a mounting base 210. The mounting base 210 defines at least part of a roller guide frame that is used to mount and support rolling components to an elevator car.

The elevator car guiding devices 202 are each configured to engage with and move along a guide rail 212 (shown in FIG. 2B). The guide rail 212 has a base 214 and a blade 216 and the elevator car guiding devices 202 engage with and move along the blade 216 of the guide rail 212. For example, the elevator car guiding device 202 shown in FIG. 2B includes a first roller 218 and two second rollers 220. In the present configuration and arrangement, as appreciated by those of skill in the art, the first roller 218 is a side-to-side roller and the second rollers 220 are front-to-back rollers. Although a specific configuration and arrangement is shown in FIGS. 2A-2B, those of skill in the art will appreciate that embodiments provided herein are applicable to various other elevator car guiding device configurations/arrangements. Each of the first and second rollers 218, 220 include roller wheels as known in the art.

The rollers 218, 220 are movably or rotatably mounted to the mounting base 210 by a first support bracket 222 and second support brackets 224, respectively. As will be appreciated by those of skill in the art, roller guides typically utilize wheels with rolling element bearings mounted on stationary pins (spindles) fixed to pivoting arms supported by the roller guides base, which in turn interfaces with the car frame, as described above. The pivoting arm is retained by a stationary pivot pin fixed to the base. A spring is configured to provide a restoring force and a displacement stop (e.g., a bumper). The roller wheels contact the guide rails of the elevator system and spin with the vertical motion of the car.

As provided herein, and as shown in FIGS. 2A-2B, embodiments of the present disclosure replaces one pivoting arm with an arm that supports a spinning shaft fixed to the roller wheel. The spinning shaft extends thru the arm to allow interface with an encoder secured to the pivoting arm with a radially compliant mount. Accordingly, to enable motion state sensing in accordance with embodiments of the present disclosure, in the embodiment shown in FIGS. 2A-2B, the first support bracket 222 also supports a motion state sensing assembly 226. The motion state sensing assembly 226, as illustrated, includes an motion state sensor 228 and a connecting element 230, as described herein. Although shown and described herein with the motion state sensing assembly 226 supported on or by the first support bracket 222, those of skill in the art will appreciate that a separate and/or dedicated support or other structure can be used to mount the motion state sensing assembly to the mounting base 210 or otherwise enable the motion state sensing assembly 226 to operably interact with at least one of the rollers 218, 220.

The motion state sensing assembly 226 is configured to determine a motion state of an elevator car within an elevator shaft. The motion state sensing assembly 226, in some embodiments such as that shown in FIGS. 2A-2B, includes a motion state sensor 228, such as an encoder. The motion state sensor 228, in some configurations, can be a rotary encoder or shaft encoder that is an electro-mechanical device that converts the angular position or motion of a shaft or axle (e.g., connecting element 230) to an analog or digital code or signal. The signal produced by the motion state sensor 228 can be transmitted to an elevator machine and/or controller to determine a specific position of the motion state sensor 228 within the elevator shaft, and thus a motion state of the elevator car to which the motion state sensor 228 is attached can be obtained. Accordingly, the motion state sensing assembly 226 can include various electrical components, such as memory, processor(s), and communication components (e.g., wired and/or wireless communication controllers) to determine a motion state and transmit such information to a controller or elevator machine such that the controller or elevator machine can determine an accurate motion state of the elevator car. With such information, the controller or elevator machine can perform improved control, such as, for example, during dynamic compensation control modes of operation and/or to prevent vibrations, oscillations, and/or bounce of the elevator car.

Figure 3:
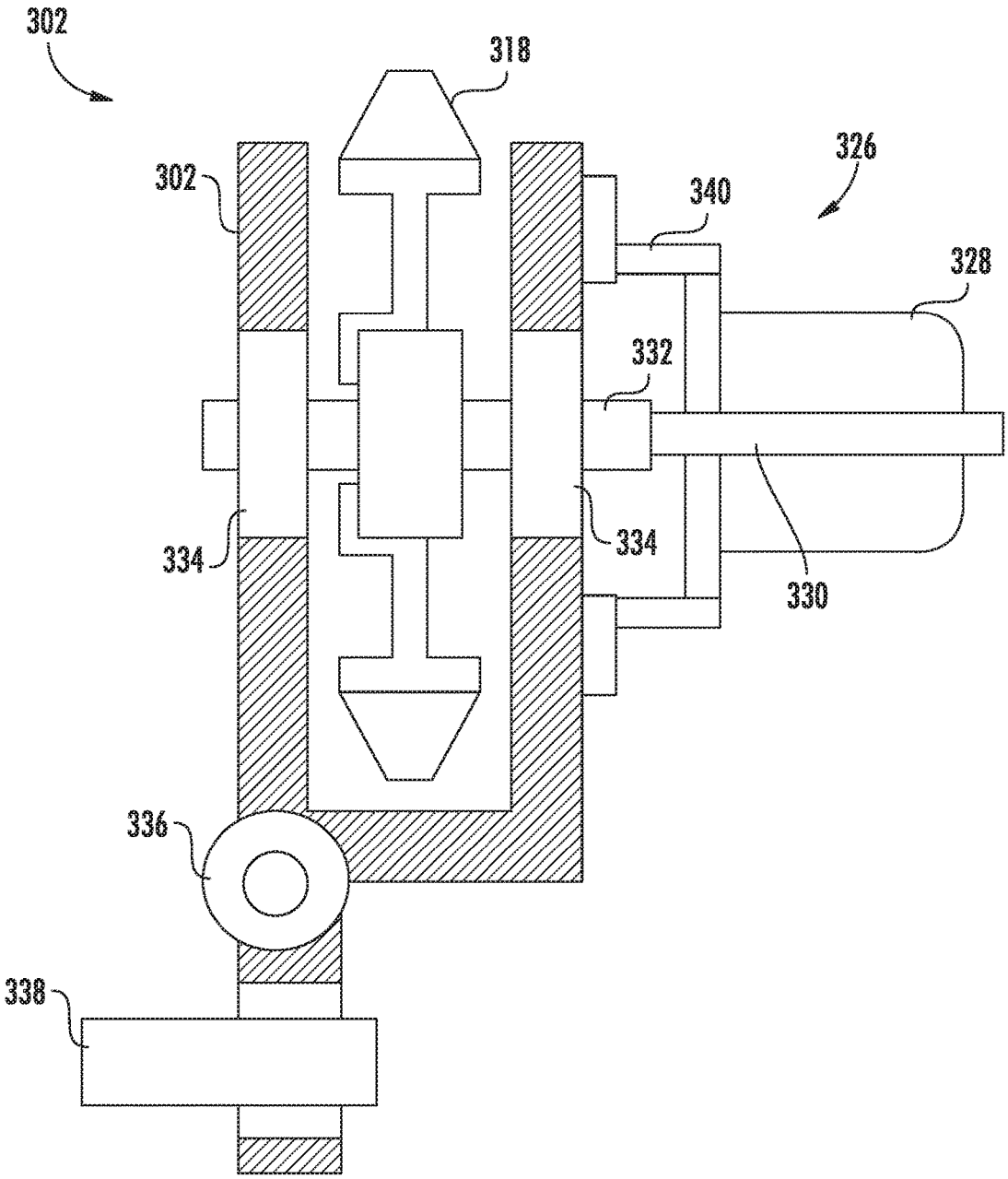
FIG. 3 is a plan view schematic illustration of a roller guide in accordance with an embodiment of the present disclosure.

Turning now to FIG. 3, a plan schematic illustration of an elevator car guiding device 302 in accordance with an embodiment of the present disclosure is shown. The elevator car guiding device 302 includes a roller 318 that engages with and rotates along a guide rail of an elevator system, as described above. The roller 318 is supported on a rotating shaft 332 that is rotatably mounted within or to a support bracket 322 by bearings 334. Also, as shown, the support bracket 322 supports a spring/spring seat 336 and a roller spindle/bushing 338.

To provide motion state sensing, as enabled herein, the support bracket 322 also has a motion state sensing assembly 326 mounted thereto. As shown, an motion state sensor 328 is mounted on a sensor bracket 340 that is fixedly attached to the support bracket 322. A connecting element 330 operably connects the motion state sensor 328 to the rotating shaft 332. Thus, as the roller 318 rotates when an elevator car moves vertically along a guide rail within an elevator shaft, the rotating shaft 332 will also rotate. As the rotating shaft 332 of the roller 318 rotates so will the connecting element 330, and the rotation of the connecting element 330 is measured by the motion state sensor 328. From this, the motion state sensor 328 generates motion state data and/or information that is used to accurately determine the motion state of the elevator car within the elevator shaft.

Figure 4:
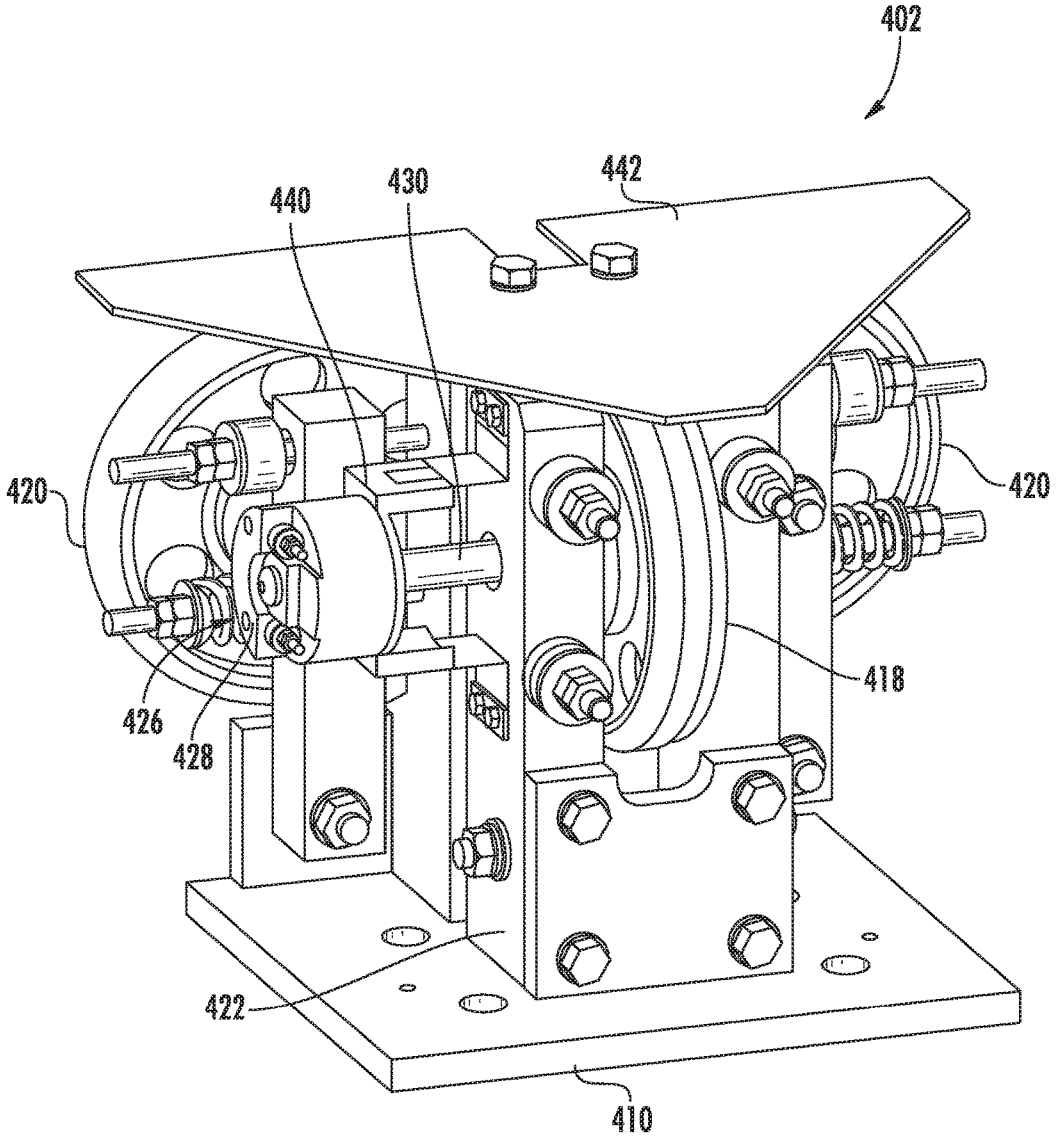
FIG. 4 is an isometric schematic illustration of a roller guide in accordance with an embodiment of the present disclosure.

Turning now to FIG. 4, an isometric schematic illustration of an elevator car guiding device 402 in accordance with an embodiment of the present disclosure is shown. The elevator car guiding device 402 includes a first roller 418 and two second rollers 420 that engage with and rotate along a guide rail of an elevator system, as described above. The first roller 418 is supported on a rotating shaft that is rotatably mounted within or to a support bracket 422 by bearings. As shown, the rollers 418, 420 are mounted to a mounting base 410 and positioned between a cover 442 and the mounting base 410. The mounting base 410 and the cover 442 can define parts of a roller guide frame that supports the elements of the roller guide on an elevator car, as will be appreciated by those of skill in the art.

To provide motion state sensing, as enabled herein, a motion state sensing assembly 426 is mounted to the support bracket 422. As shown, an motion state sensor 428 is mounted on a sensor bracket 440 that is fixedly attached to the support bracket 422. A connecting element 430 operably connects the motion state sensor 428 to the rotating shaft of the first roller 418. Thus, as the first roller 418 rotates when an elevator car moves vertically along a guide rail within an elevator shaft, the connecting element 430 will rotate and the rotation of the connecting element 430 is measured by the motion state sensor 428. From this, the motion state sensor 428 generates motion state data and/or information that are used to accurately determine the motion state of the elevator car within the elevator shaft.

Advantageously, embodiments provided herein provide an integrated motion state sensing assembly into a roller guide of an elevator car to thus provide accurate motion state information of the elevator car within the elevator shaft. Accordingly, advantageously, for example, direct measurement of elevator car distance from a landing can be obtained for enhanced control of re-leveling (e.g., dynamic compensation control mode of operation). Further, advantageously, motion state sensing assemblies provided herein can be employed, for example, to determine car motion state relative to door zones, car position and/or velocity for motion control, over-speed detection, and/or unintended car movement detection.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments.

For example, various configurations and/or designs may be employed without departing from the scope of the present disclosure.

In one non-limiting embodiment, a connecting element of a motion state sensing assembly is operably connected to a roller wheel of a side-to-side roller, such as that shown and described above. The motion state sensor, or a portion thereof, (or other part of the motion state sensing assembly) can be directly connected and/or mounted to a rotating axle or shaft of the roller wheel.

In another non-limiting embodiment, the motion state sensing assembly can be operably connected to a front-to-back roller. In such embodiments, the structure, arrangement, and configuration of the motion state sensing assembly can be similar to that shown and described above.

In another non-limiting embodiment, rather than operably connecting to a roller wheel of the roller guide, and additional roller wheel (e.g., dedicated motion state sensing roller wheel) can be mounted on or above the roller guide. For example, a motion state sensor and operably connected additional roller can be mounted to the cover 442 illustrated in FIG. 4. The motion state sensing roller wheel, in such embodiments, would engage with and rotate along a guide rail of the elevator system.

In another non-limiting embodiment, the motion state sensing assembly can be configured to be operably connected directly to a roller wheel. For example, the motion state sensor can be an encoder that is in contact with a motion part of a roller. That is, a wheel of an encoder can be directly in contact with a portion of the roller wheel such that as the roller wheel rotates the encoder wheel rotates and the motion state can be measured. In such embodiments, the encoder can be mounted using spring tension or other mounting means.

Further, although shown and described above with respect to elevator car guiding devices positioned on the top of an elevator car, those of skill in the art will appreciate that embodiments provided herein can be applied to any elevator car guiding devices (e.g., roller guides) of an elevator system. For example, those of skill in the art will appreciate that a traditional elevator car will be equipped with four roller guides. Embodiments provided herein can be applied to one or more of the roller guides to provide motion state sensing at one or more roller guides of the elevator car.

Additionally, although shown and described with a single motion state sensor (e.g., an encoder) on the elevator car guiding device, those of skill in the art will appreciate that in some embodiments, multiple motion state sensors can be part of a single elevator car guiding device. In such embodiments, the multiple motion state sensors can measure based on one or more rollers, such that each sensor is configured with respect to a different roller or two or more sensors are configured with respect to a single (the same) roller. Accordingly, various alternative configurations and/or arrangements are considered herein without departing from the scope of the present disclosure.

Accordingly, the present disclosure is not to be seen as limited by the foregoing description, but is only limited by the scope of the appended claims.

What is claimed is:

1. An elevator car guiding device comprising:

a roller guide frame including a mounting base to be mounted to an elevator car;

a first roller supported on the mounting base, the first roller having a first roller wheel configured to engage with and rotate along a guide rail and prevent movement of the elevator car in a side-to-side direction;

a second roller supported on the mounting base, the at least one second roller having a second roller wheel configured to engage with and rotate along the guide rail and prevent movement of the elevator car in a front-to-back direction; and a motion state sensing assembly mounted to the roller guide frame and configured to measure a motion state of the elevator car within an elevator shaft of the elevator system, the motion state sensing assembly operably interacting with the first roller wheel.

2. The elevator car guiding device of claim 1, wherein the motion state sensing assembly is operably connected to one of (i) the first roller, (ii) one of the at least one second roller, or (iii) the guide rail.

3. The elevator car guiding device of claim 1, the motion state sensing assembly comprising:

an encoder; and a connecting element operably connecting the encoder to one of the roller wheels, wherein the connecting element rotates as the respective roller wheel rotates, the encoder configured to measure rotation of the connecting element to determine a motion state of the elevator car.

4. The elevator car guiding device of claim 1, wherein the roller guide frame includes a cover, wherein the first roller and the at least one second roller are arranged between the mounting base and the cover, and wherein the motion state sensing assembly is mounted to the cover.

5. The elevator car guiding device of claim 1, wherein the roller guide frame includes a first support bracket that supports the first roller wheel within the roller guide and wherein the motion state sensing assembly comprises an encoder bracket that fixedly secures an encoder to the first support bracket.

6. The elevator car guiding device of claim 5, further comprising a connecting element operably connected the encoder to the first roller wheel.

7. The elevator car guiding device of claim 1, wherein the motion state sensing assembly comprises a communication component configured to transmit motion state data from the motion state sensing assembly to an elevator controller.

8. The elevator car guiding device of claim 1, wherein a portion of the motion state sensing assembly is operably in direct contact with the first roller wheel.

9. The roller guide of claim 1, wherein the at least one second roller is two second rollers with each second roller having a respective roller wheel oriented about the guide rail.

10. The elevator car guiding device of claim 9, wherein the motion state sensing assembly is operably connected to one of the two second roller wheels.

11. An elevator system comprising:

an elevator shaft having a plurality of landings;

a guide rail extending along the elevator shaft;

an elevator machine;

an elevator car operably connected to the elevator machine to be driven within the elevator shaft along the guide rail; and an elevator car guiding device mounted to the elevator car, the elevator car guiding device comprising:

a roller guide frame including a mounting base mounted to the elevator car;

a first roller supported on the mounting base, the first roller having a first roller wheel configured to engage with and rotate along the guide rail and prevent movement of the elevator car in a side-to-side direction;

at least one second roller supported on the mounting base, the at least one second roller having a second roller wheel configured to engage with and rotate along the guide rail and prevent movement of the elevator car in a front-to-back direction; and a motion state sensing assembly mounted to the roller guide frame and configured to measure a motion state of the elevator car within the elevator shaft, the motion state sensing assembly operably interacting with the first roller wheel.

12. The elevator system of claim 11, wherein the motion state sensing assembly is operably connected to one of (i) the first roller, (ii) one of the at least one second roller, or (iii) the guide rail.

13. The elevator system of claim 11, the motion state sensing assembly comprising:

an encoder; and a connecting element operably connecting the encoder to one of the roller wheels, wherein the connecting element rotates as the respective roller wheel rotates, the encoder configured to measure rotation of the connecting element to determine a motion state of the elevator car within the elevator shaft.

14. The elevator system of claim 11, wherein the roller guide frame includes a cover, wherein the first roller and the at least one second roller are arranged between the mounting base and the cover, and wherein the motion state sensing assembly is mounted to the cover.

15. The elevator system of claim 11, wherein the roller guide frame includes a first support bracket that supports the first roller wheel within the roller guide and wherein the motion state sensing assembly comprises an encoder bracket that fixedly secures an encoder to the first support bracket.

16. The elevator system of claim 15, further comprising a connecting element operably connected the encoder to the first roller wheel.

17. The elevator system of claim 11, wherein the motion state sensing assembly comprises a communication component configured to transmit motion state data from the motion state sensing assembly to the elevator machine.

18. The elevator system of claim 11, wherein a portion of the motion state sensing assembly is operably in direct contact with the first roller wheel.

19. The elevator system of claim 11, wherein the at least one second roller is two second rollers with each second roller having a respective roller wheel oriented about the guide rail.

20. The elevator system of claim 19, wherein the motion state sensing assembly is operably connected to one of the two second roller wheels.

* * * * *